US012226002B1

(12) United States Patent
Pena

(10) Patent No.: US 12,226,002 B1
(45) Date of Patent: Feb. 18, 2025

(54) HAIR-STYLING TOOL HOLDING DEVICE

(71) Applicant: Calvin Pena, Indianapolis, IN (US)

(72) Inventor: Calvin Pena, Indianapolis, IN (US)

( * ) Notice: Subject to any disclaimer, the term of this patent is extended or adjusted under 35 U.S.C. 154(b) by 131 days.

(21) Appl. No.: 17/840,852

(22) Filed: Jun. 15, 2022

(51) Int. Cl.
*A45D 44/02* (2006.01)

(52) U.S. Cl.
CPC ..... *A45D 44/02* (2013.01)

(58) Field of Classification Search
CPC ..... A45D 44/02
USPC ..... 206/349; 224/222
See application file for complete search history.

(56) References Cited

U.S. PATENT DOCUMENTS 6,062,232 A * 5/2000 Johnson ..... A45D 44/02 132/273
6,170,680 B1 1/2001 Hung
7,048,162 B2 * 5/2006 Frye ..... B25H 3/00 224/222
7,273,057 B1 * 9/2007 Capaldo ..... A45D 44/02 132/148
7,909,162 B1 3/2011 Barrett
8,517,233 B2 * 8/2013 Podda-Heubach .... A61B 90/50 224/267
9,801,469 B2 10/2017 Hodge
2006/0237496 A1 * 10/2006 Brennan ..... A45F 5/00 224/222
2008/0011794 A1 * 1/2008 Daniel ..... A45F 5/022 224/267
2009/0272774 A1 * 11/2009 Craig ..... A45F 5/00 224/222
2013/0020359 A1 * 1/2013 Green ..... A45F 5/00 224/267
2013/0098955 A1 * 4/2013 Lamey ..... A45C 3/001 224/222
2014/0014696 A1 * 1/2014 Gwynn, Jr. ..... A45D 44/00 224/222
2014/0131402 A1 * 5/2014 Holmes ..... A45F 5/00 224/222
2014/0263496 A1 * 9/2014 Zimmerman ..... B43K 23/016 224/222
2016/0106201 A1 * 4/2016 Taylor ..... A45F 5/00 224/222

(Continued)

OTHER PUBLICATIONS

Wrist Arm Magnetic Shear Holder "Wrist Wrap". Product Listing [online]. © 2022 Body Toolz Inc. [retrieved on Feb. 25, 2021]. Retrieved from the Internet: <URL: https://www.bodytoolz.com/Shear-Holder-Magnetic-Wrist-Band-Armor.aspx>.

(Continued)

*Primary Examiner* — Jacob K Ackun
(74) *Attorney, Agent, or Firm* — Cramer Patent & Design PLLC; Aaron R. Cramer

(57) ABSTRACT

A Hair-Styling Tool Holding Device is an elastic sleeve for an arm having a plurality of barbershop tool retaining means disposed about the exterior surface of the sleeve. The sleeve may have an open first end and an open second end and is configured for disposal on an arm of a hairdresser. The device may also have a first elastic portion which is disposed on a perimeter of the open first end of the sleeve, a second elastic portion which is disposed on a perimeter of the open second end of the sleeve, a plurality of first and second attachment portions which are configured to hold and organize a plurality of hairdressing tools.

1 Claim, 5 Drawing Sheets

(56) References Cited

U.S. PATENT DOCUMENTS

2016/0174674 A1* 6/2016 Oberpriller ..... A45C 11/00
224/191

OTHER PUBLICATIONS

Barber—Hairdresse Tool Roll, brown leather, (personalized). Product Listing [online]. © 2022 Etsy, Inc. [retrieved on Jun. 13, 2022]. Retrieved from the Internet: <URL: https://www.etsy.com/listing/544347997/barber-hairdresse-tool-roll-brown?ga_order=most_relevant&ga_search_type=all&ga_view_type=gallery&ga_search_query=Deluxe+Barber+and+Hair+Stylist+Tool+Roll&ref=sr_gallery-1-6&frs=1&organic_search_click=1>.

Art Storage arm brush holder. Product Listing [online]. Pinterest [retrieved on Feb. 25, 2021]. Retrieved from the Internet: <https://www.pinterest.com/pin/480688960201436963/>.

Wrist Dagger. Product Listing [online]. © 2011-2022 OZ Abstract [retrieved on Feb. 25, 2021]. Retrieved from the Internet: <https://www.oztokyo.com/en/catalogue/brand/nakayama-hidetoshi-c365/category/knifes/NHKB02.html>.

Black Cow Leather Wristband Arm Money Wallet Hand Cuff Wrist Band Brand New. Product Listing [online]. © 2022 Etsy, Inc. [retrieved on Jun. 13, 2022]. Retrieved from the Internet: <https://www.etsy.com/listing/752252379/black-cow-leather-wristband-arm-money?ga_order=most_relevant&ga_search_type=all&ga_view_type=gallery&ga_search_query=wrist+wallet+black+gold&ref=sr_gallery-1-5&frs=1&organic_search_click=1>.

* cited by examiner

HAIR-STYLING TOOL HOLDING DEVICE

RELATED APPLICATIONS

None.

FIELD OF THE INVENTION

The presently disclosed subject matter is directed to a holding device for tools and more specifically for a holding device for hair-styling tools.

BACKGROUND OF THE INVENTION

The proper tools utilized by a barber or hairstylist to cut the hair of a customer are numerous. Whether razors, scissors, clipper guards, combs or the like, the business of cutting hair often requires each tool to be easily accessible to the barber or stylist.

Traditionally most of the various aforementioned tools are stored around the barber or stylist chair however seldom are all the tools found in one specific location. While, under normal business conditions—the time taken by the barber or stylist to procure a desired tool is negligible; under very busy business conditions the lost time can be problematic and create increased service times and needless fatigue.

Accordingly, there exists a need for a means by which the various tools utilized by a barber or stylist are located in one convenient and easily acceptable location. The development of the hair-style tool holding device fulfills this need.

SUMMARY OF THE INVENTION

The principles of the present invention provide for a holding device that has a sleeve having an open first end and an open second end, a first elastic portion disposed on a perimeter of the open first end of the sleeve, a second elastic portion disposed on a perimeter of the open second end of the sleeve, a plurality of first attachment portions configured to hold and organize a plurality of hairdressing tools, and a plurality of second attachment portions configured to hold and organize the hairdressing tools. The sleeve is configured for disposal on an arm of a hairdresser.

The open first end may be a diameter smaller than a diameter of the open second end. The sleeve may taper in diameter from the open second end to the first end. The sleeve may be configured for disposal on an arm of a barber. The sleeve may be made of elastic material. The sleeve may be made of non-elastic cloth. The sleeve may be made of synthetic material. The first elastic portion and the second elastic portion may be adapted to be fitted around an arm of a user to prevent a plurality of unwanted debris and a plurality of unwanted liquids from contacting the arm of the user. The hairdressing tools retained within the first attachment portions may be disposed perpendicularly to the sleeve and the arm of the user. The hairdressing tools retained within the second attachment portions may be disposed perpendicularly to the sleeve and the arm of the user. The first attachment portions may be longer than the second attachment portions.

The first attachment portions and the second attachment portions may be separate and hold one or more different sized hairdressing tools. The first attachment portions and the second attachment portions may include a quick-release type attachment for each of the hairdressing tools. The first attachment portions and the second attachment portions may include an elastic band to retain each of the hairdressing tools to the sleeve such that the hairdressing tools slide under the first attachment portions and the second attachment portions to be withdrawn when needed. The first attachment portions may be elongated and oriented linearly along diametrically a plurality of opposing sides of the sleeve. The first attachment portions and the second attachment portions may include a magnetic connection allowing the hairdressing tools that may be ferromagnetic to magnetically attach with the respective first attachment portions and the respective second attachment portions of the sleeve. Either the first attachment portions or the second attachment portions may include the magnetic connection.

The hairdressing tools may be selected from the group consisting of one or more clipper guards, one or more scissors, and one or more razors. The second attachment portions may be disposed between the first attachment portion disposed on an opposite side of the sleeve. There are four of the second attachment portions that may be linearly disposed about a common bisecting line and may be equidistantly spaced apart from each other disposed on the sleeve.

BRIEF DESCRIPTION OF THE DRAWINGS

These and other features, aspects, and advantages of the present disclosure will become better understood with regard to the following description, appended claims, and accompanying drawings where:

DESCRIPTIVE KEY

Figure 1:
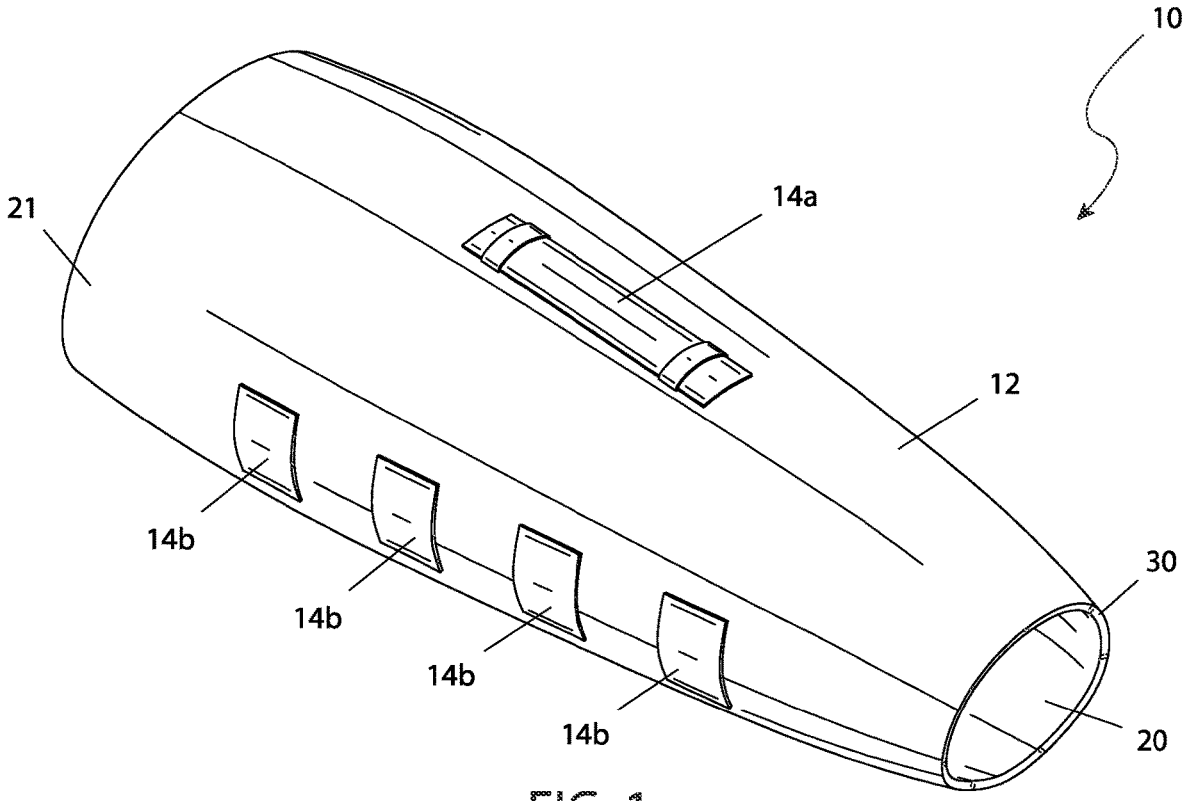
FIG. 1 is a first perspective view of a holding device, according to an embodiment of this disclosure.
Figure 2:
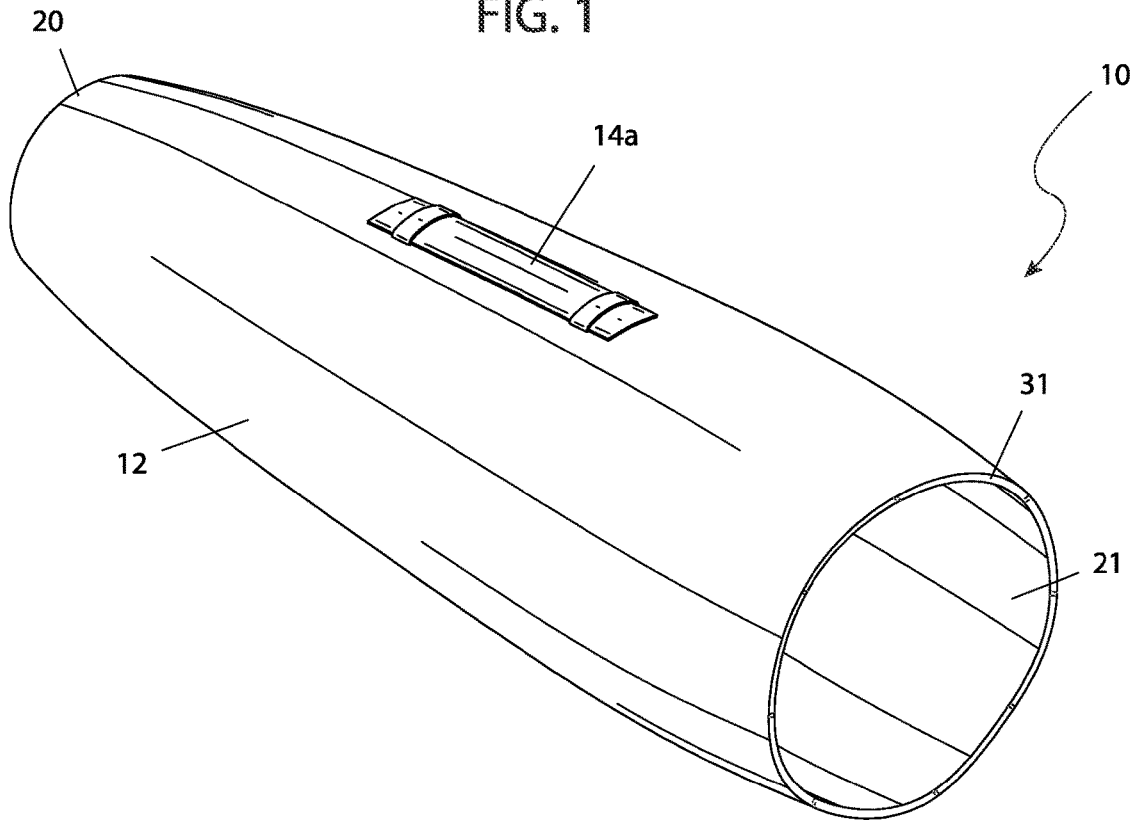
FIG. 2 is a second perspective view of a holding device, according to an embodiment of this disclosure.
Figure 3:
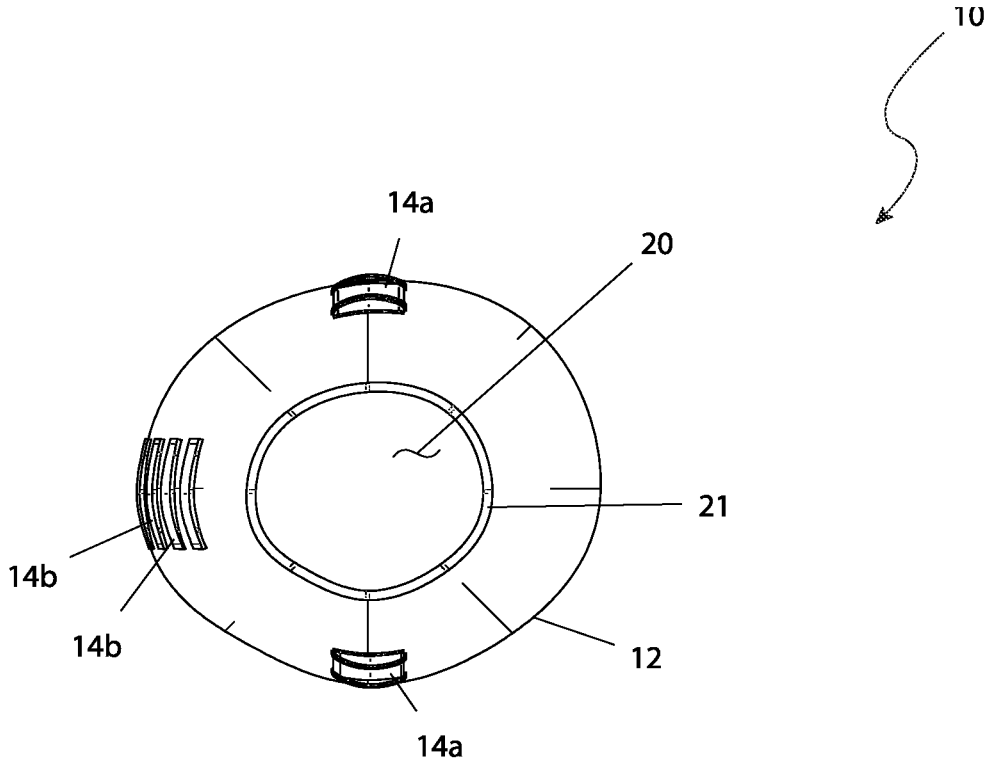
FIG. 3 is an end view of a holding device, according to an embodiment of this disclosure.
Figure 4:
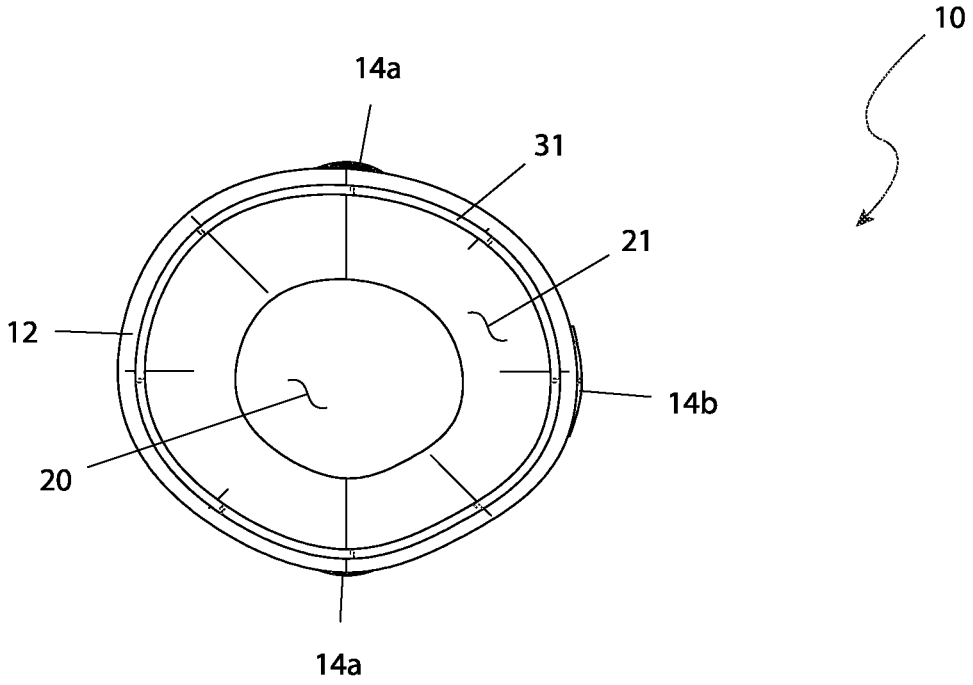
FIG. 4 is an opposite end view of a holding device, according to an embodiment of this disclosure.
Figure 5:
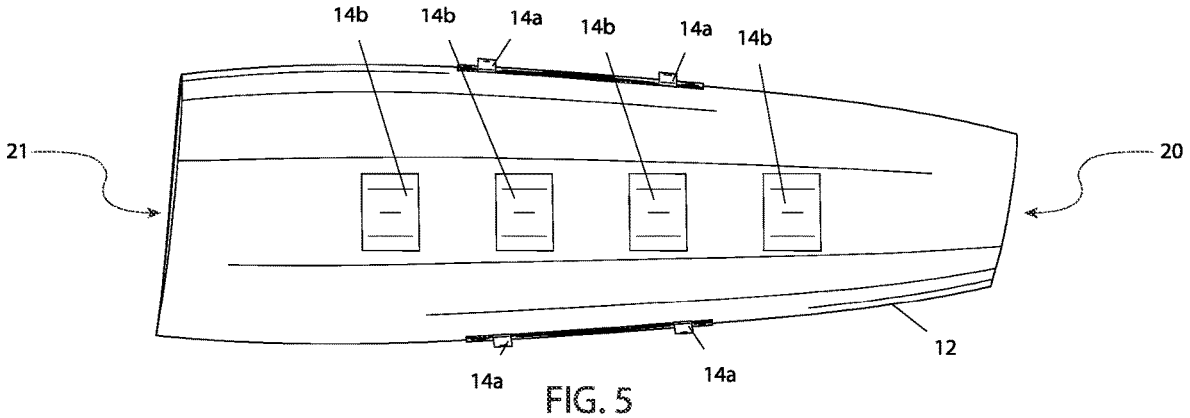
FIG. 5 is a side view of a holding device, according to an embodiment of this disclosure.
Figure 6:
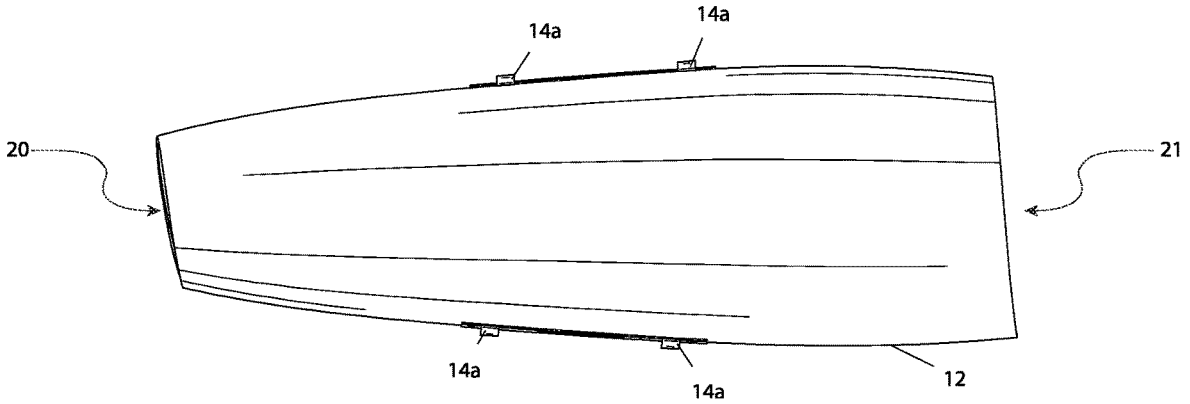
FIG. 6 is an opposite side view of a holding device, according to an embodiment of this disclosure.

10 holding device
12 sleeve
14*a* first attachment portion
14*b* second attachment portion
20 first end
21 second end
30 first elastic portion
31 second elastic portion
T tools

DETAILED DESCRIPTION

The following disclosure is provided to describe various embodiments of a holding device 10, particularly suited for holding hairdresser tools T. In some cases, hairdressers need a mechanism to provide an organized and quick access to the tools T most needed when providing a service. In some embodiments, when a hairdresser is busy, the hairdresser is working fast and every second counts. The holding device 10 of the present disclosure provides an organized means for the tools T and also provides easy access to the tools T while working. The holding device 10 assists with avoiding having to walk back and forth to the hairdresser's station. In some embodiments, the holding device 10 is configured to resist and/or prevent tools T from dropping to the floor and then having to take time to clean them.

Skilled artisans will appreciate additional embodiments and uses of the present invention that extend beyond the examples of this disclosure. Terms included by any claim that may be presented in any yet-to-be-filed non-provisional patent application are to be interpreted as defined within this disclosure. Singular forms should be read to contemplate and disclose plural alternatives. Similarly, plural forms should be read to contemplate and disclose singular alternatives. Conjunctions should be read as inclusive except where stated otherwise.

Expressions such as "at least one (1) of A, B, and C" should be read to permit any of A, B, or C singularly or in combination with the remaining elements. Additionally, such groups may include multiple instances of one (1) or more element in that group, which may be included with other elements of the group. All numbers, measurements, and values are given as approximations unless expressly stated otherwise.

Figure 7:
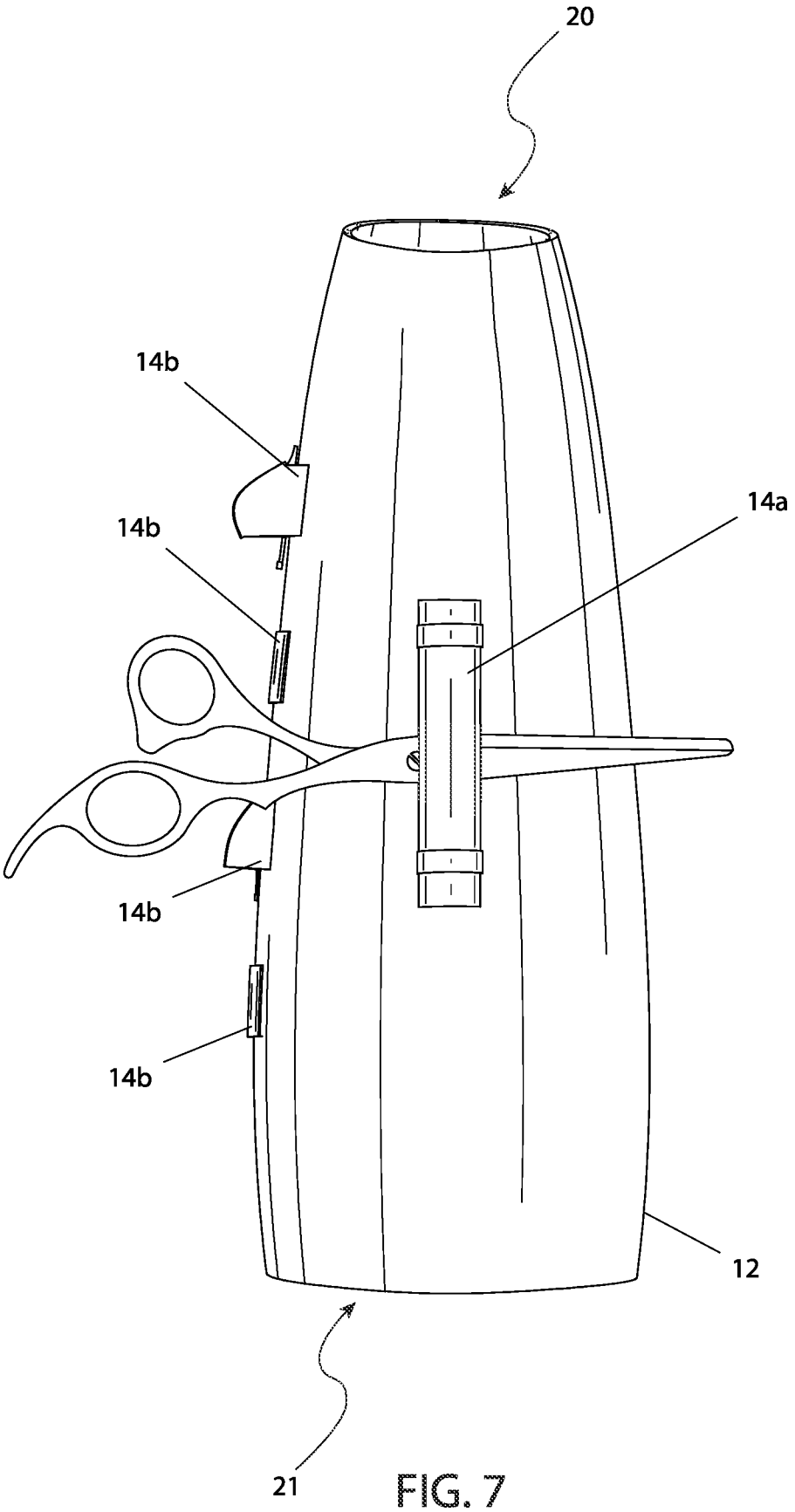
FIG. 7 is a side view of a holding device, according to an embodiment of this disclosure.
Figure 8:
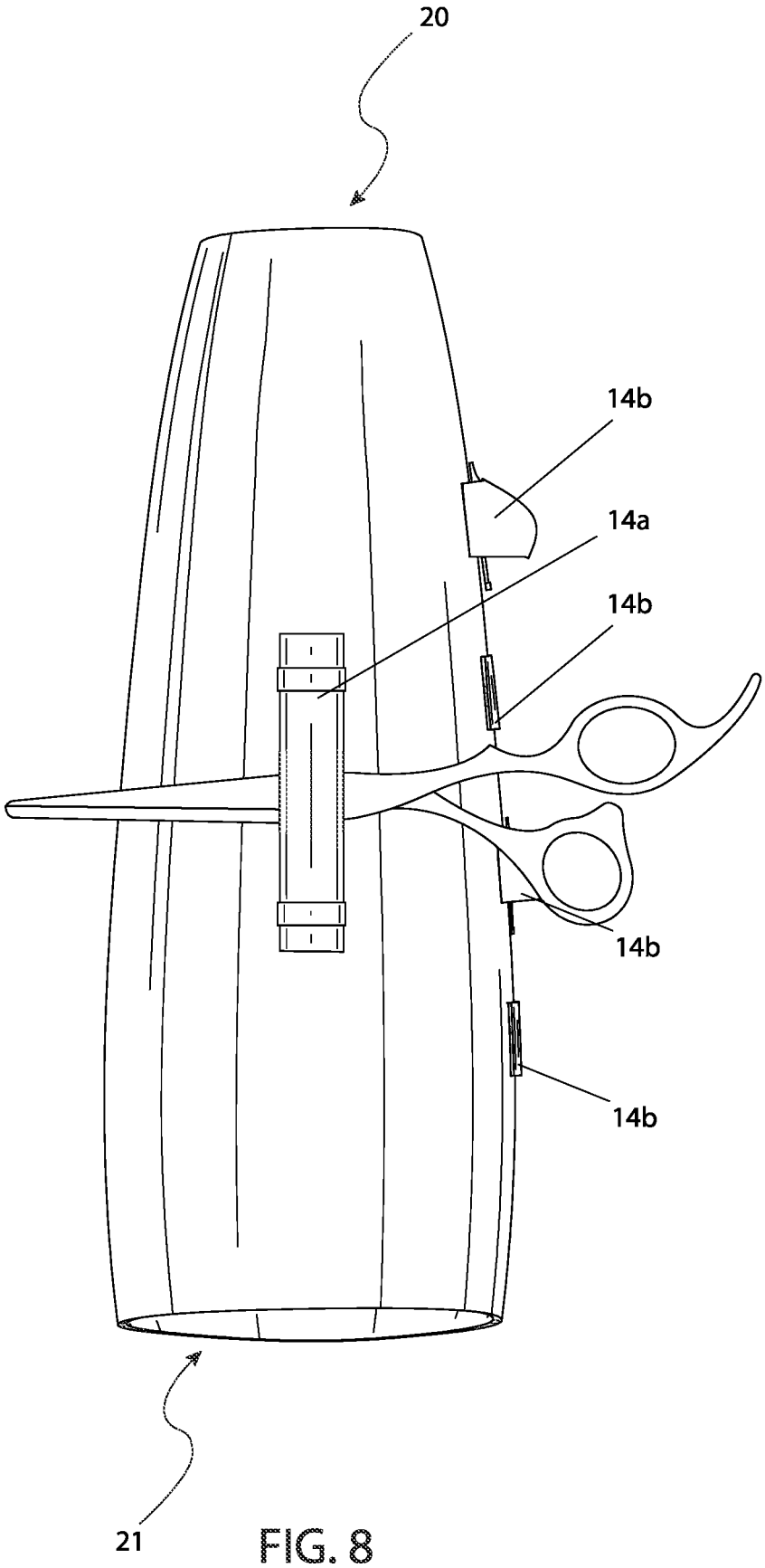
FIG. 8 is an opposite side view of a holding device, according to an embodiment of this disclosure.

Various aspects of the present disclosure will now be described in detail, without limitation. Skilled readers should not view the inclusion of any alternative labels as limiting in any way. Referring now to FIGS. 1-8, an illustrative holding device 10 for hairdressers will now be discussed in more detail. The holding device 10 includes a sleeve 12 configured for disposal on the arm of a hairdresser or barber. The holding device 10 is configured to hold the most commonly used cutting accessories, for example tools T, as shown in FIGS. 7 and 8. The holding device 10 provides ease of access to each tool T from start to finish of a service to a client.

The sleeve 12 includes an open first end 20 and an open second end 21. The first end 20 has a diameter smaller than the second end 21, such that the sleeve tapers in diameter from the second end 21 to the first end 20. The material of construction of the sleeve 12 may be fully elastic or it may have a relatively non-elastic cloth or synthetic material. Surrounding the perimeter of the first end 20 may be a first elastic portion 30. Similarly, surrounding the perimeter of the second end 21 may be a second elastic portion 31. The sleeve 12 is sized to enable a comfortable fit of an arm of a user, when the arm is fully clothed or not. The first end 20 has a diameter roughly slightly larger than a wrist size of a human, whereas the second end 21 has a diameter roughly slightly larger than that of a bicep of a human. The first elastic portion 30 and second elastic portion 31 may provide a more tight and snug fit about the arms of the user and also to prevent any unwanted debris or liquids contacting the arm of the user.

The sleeve 12 includes a plurality of first attachment portions 14*a* and second attachment portions 14*b*. The first and second attachment portions 14*a*, 14*b* are configured to hold various tools T, for example, clipper guards, scissors or razors. The first and second attachment portions 14*a*, 14*b* can be independently configured in various sizes to hold different sized tools T. The first and second attachment portions 14*a*, 14*b* provide for a quick-release type attachment of tools T. In some embodiments, the first and second attachment portions 14*a*, 14*b* include an elastic band to retain the tools T to the sleeve 12 such that the tools T slide under the first and second attachment portions 14*a*, 14*b* and can be easily withdrawn when needed. In some embodiments, either or both and some or all of the first or second attachment portions 14*a*, 14*b* include a magnetic connection allowing tools T that are ferromagnetic to magnetically attach with the respective first and second attachment portions 14*a*, 14*b* of the sleeve 12.

The first attachment portions 14*a* are elongated and oriented linearly along diametrically opposing sides of the sleeve 12. Referring now to the figures, these sides can be described as the top side and the bottom side of the sleeve 12. Any tools T retained within the first attachment portions 14*a* are thusly disposed perpendicularly to the sleeve 12 and the arm of the user. The second attachment portions 14*b* are located midway between the opposing first attachment portion 14*a* locations on one (1) side only and are oriented perpendicularly therefrom. Referring now to the figures, this side can be described as the outer side of the sleeve 12 (i.e., away from the body of the user). Any tools T retained within the second attachment portions 14*b* are thusly disposed perpendicularly to the sleeve 12 and the arm of the user. In at least one (1) embodiment, there are four (4) second attachment portions 14*b*, linearly disposed about a common bisecting line and equidistantly spaced apart from each other. The first attachment portions 14*a* are longer than the second attachment portions 14*b*.

The sleeve 12 provides a comfortable fit with an easy access to the tools T. For example, the sleeve 12 reduces the number of times the hairdresser has to go back and forth to their station to find and/or grab a new tool T.

In operation, the sleeve 12 is translated along the user's arm to a comfortable fit via insertion of the user's arm through the second end 21 and the first end 20 such that the first end 20 terminates roughly adjacent a wrist of the user. If present, the first elastic portion 30 and second elastic portion 31 can provide a snug fit. The user can attach various tools T that will be needed for a particular service. As the user works, the user can reach towards the sleeve 12 to detach the needed tool T from the particular first or second attachment portion 14*a*, 14*b*. When the user is finished with that particular tool T, the user can reattach the tool T to the particular first or second attachment portion 14*a*, 14*b* for future easy access and in order then reacquire the next tool T as needed. In some methods of use, the user can wear a single sleeve 12 on both arms.

While various aspects of the present invention have been described in the above disclosure, the description of this disclosure is intended to illustrate and not limit the scope of the invention. The invention is defined by the scope of the claims of a corresponding nonprovisional utility patent application and not the illustrations and examples provided in the above disclosure. Skilled artisans will appreciate additional aspects of the invention, which may be realized in alternative embodiments, after having the benefit of the above disclosure. Other aspects, advantages, embodiments, and modifications are within the scope of the claims of a corresponding nonprovisional utility patent application.

What is claimed is:

1. A hairdresser's arm sleeve tool holder consisting of:

a tapered sleeve configured to extend from near the wrist to the bicep of a user's arm, the tapered sleeve having a first end with a smaller diameter than a second end, wherein the first end has a diameter slightly larger than a human wrist and the second end has a diameter slightly larger than a human bicep;

a sleeve body made from a material selected from the group consisting of fully elastic material, relatively non-elastic cloth, or synthetic material, the sleeve body configured to snugly fit and adapt to both clothed and unclothed arms of the user; and, a plurality of attachment portions disposed on the sleeve body for holding tools, wherein:

a first set of attachment portions are elongated and oriented linearly along diametrically opposing sides of the sleeve body, designed to hold tools such as clippers and scissors in a perpendicular orientation relative to the sleeve body;

a second set of attachment portions are located midway between the opposing first set of attachment portions on one side of the sleeve body and oriented perpendicularly therefrom, the second set of attachment portions comprising four attachment portions, linearly disposed about a common bisecting line and equidistantly spaced apart from each other;

the first and second set of attachment portions are independently configured in various sizes to hold different sized tools, allowing for customizable tool retention; and, wherein at least one of the first or second set of attachment portions includes an elastic band to retain the tools to the sleeve body, wherein the tools are slid under the attachment portions and can be easily withdrawn when needed;

wherein the first and second ends of the tapered sleeve include elastic portions surrounding the perimeter to provide a tight and secure fit around the user's arm while preventing unwanted debris or liquids from contacting the arm; and, wherein the sleeve body is configured for quick-release type attachment of tools, allowing the user to easily attach and detach tools as needed during the provision of services to a client, thereby reducing the need for the user to walk back and forth to a hairdresser's station.

* * * * *